US005797326A

United States Patent [19]

Buschulte et al.

[11] Patent Number: 5,797,326

[45] Date of Patent: Aug. 25, 1998

[54] METHOD FOR APPLYING SPACING MATERIAL TO A PRINTED SHEET OF PAPER, AND A SHEET-FED PRINTING PRESS EQUIPPED FOR PERFORMING THE METHOD

[75] Inventors: Rainer Buschulte, Bad Schoenborn; Juergen Kern, Mauer; Michael Mueller, Biblis; Harald Schwahn, Heidelberg, all of Germany

[73] Assignee: Heidelberger Druckmaschinen AG, Heidelberg, Germany

[21] Appl. No.: 575,491

[22] Filed: Dec. 20, 1995

[30] Foreign Application Priority Data

Dec. 20, 1994 [DE] Germany ..... 44 45 457.0

[51] Int. Cl.[6] ..... B41F 35/00

[52] U.S. Cl. ..... 101/483; 101/491; 101/493; 101/416.1; 101/424.2

[58] Field of Search ..... 101/483, 491, 101/493, 424, 424.2, 419, 416.1

[56] References Cited

U.S. PATENT DOCUMENTS

| | | | |
|---|---|---|---|
| 1,638,572 | 9/1927 | Greenway | 101/424.2 |
| 2,142,666 | 1/1939 | Bucy | 101/416.1 |
| 2,142,668 | 1/1939 | Bucy | 101/416.1 |
| 2,317,370 | 4/1943 | Geese | 101/416.1 |
| 2,317,372 | 4/1943 | Gessler et al. | 101/416.1 |
| 2,321,140 | 6/1943 | Grupe | 101/424.1 |
| 3,050,416 | 8/1962 | Yahnke et al. | |
| 4,270,483 | 6/1981 | Butler et al. | 101/424.1 |
| 4,867,063 | 9/1989 | Baker et al. | 101/424.2 |
| 4,869,921 | 9/1989 | Gabel et al. | 101/424.2 |
| 4,882,992 | 11/1989 | Schmoeger | 101/424.2 |
| 5,090,626 | 2/1992 | Plantsch | 239/654 |
| 5,397,651 | 3/1995 | Wirz | |
| 5,603,264 | 2/1997 | DeMoore | 101/483 |

FOREIGN PATENT DOCUMENTS

| | | | |
|---|---|---|---|
| 0 424 740 | 5/1991 | European Pat. Off. | |
| 0 588 091 | 3/1994 | European Pat. Off. | |
| 2 157 424 | 6/1973 | France | |
| 1 932 179 | 3/1970 | Germany | |
| 2047350 | 3/1972 | Germany | 101/424.2 |
| 2151185 | 7/1979 | Germany | 101/424.2 |
| 29 36 754 | 4/1981 | Germany | |
| 32 29 035 | 1/1984 | Germany | |
| 2 124 979 | 2/1984 | Germany | |
| 33 30 665 | 3/1985 | Germany | |
| 35 33 436 | 3/1987 | Germany | |
| 3819203 | 12/1989 | Germany | |
| 89 11 255.5 | 12/1989 | Germany | |
| 39 04 311 | 8/1990 | Germany | |
| 42 24 443 | 1/1994 | Germany | |
| 43 41 566 | 6/1995 | Germany | |
| 4341566 | 6/1995 | Germany | |
| 509880 | 8/1971 | Switzerland | |
| 1020544 | 2/1966 | United Kingdom | |

OTHER PUBLICATIONS

Japanese Patent Abstract No. 5–85074, dated Apr. 6, 1993.

Patent Abstract of Japan No. JP 60–036 167 (Kenichi et al.), Jul. 6, 1985.

Patent Abstract of Japan No. JP 10–24 796 (Uji et al.), May 12, 1989.

*Primary Examiner*—Eugene H. Eickholt

*Attorney, Agent, or Firm*—Herbert L. Lerner; Laurence A. Greenberg

[57] ABSTRACT

Method for applying spacing material to a sheet printed by a printing press includes providing spacing material which is solid at least at ambient temperature, spotwise applying individual spacing material particles formed from the spacing material onto a surface of the sheet, and fixing the applied spacing material particles to the sheet; and a printing-press device for performing the method.

16 Claims, 5 Drawing Sheets

METHOD FOR APPLYING SPACING MATERIAL TO A PRINTED SHEET OF PAPER, AND A SHEET-FED PRINTING PRESS EQUIPPED FOR PERFORMING THE METHOD

BACKGROUND OF THE INVENTION

Field of the Invention

The invention relates to a method for applying a spacing material to a printed sheet of paper, and a sheet-fed printing press equipped for performing the method.

With the application of a spacing material to a printed sheet of paper, the goal is to protect the printed image from damage which can particularly occur in a delivery of a sheet-fed printing press during the formation of a delivery pile.

To that end, one proposal amongst others has been made heretofore in the state of the art to dust the surface of printed sheets of paper with a powder. A dusting device suitable for this purpose is disclosed, for example, in the published German Patent Document 38 19 203 A1. The use of powder or pulverulent materials also has disadvantageous consequences. For example, the sheet-fed printing press is soiled by the powder which is used, because the powder clings not only the surface of the printed sheet but also, and particularly, becomes deposited on sheet transport means which convey a respective sheet from a printing unit to a stacking device. Moreover, the dusted powder can come loose from the printed sheet during a repeated printing operation or press run and can thus contaminate the printing units of the sheet-fed printing press and consequently result in an increased rate of spoilage production.

From the published Japanese Patent Document Hei 5-85074 A, it has become known for a printed sheet of paper to be coated with an aqueous emulsion of wax and an alcohol-fatty acid ester. This emulsion is applied uniformly and areally over the entire surface of a previously printed sheet. A disadvantage thereof, however, is that especially with large-size or large-format printed sheets, considerable quantities of the aforementioned emulsion are needed, and that when such areally-coated printed sheets are stacked in a sheet pile, no air cushion can form between the individual sheets. The formation of a sheet pile with straight edges, in particular, becomes more difficult as a result thereof.

It is accordingly an object of the invention to provide a method for applying spacing material to a printed sheet, and a sheet-fed printing press equipped for performing the method, with which the aforementioned disadvantages are eliminated and, in particular, with which good and damage-free alignability of a pile of printed sheets is achieved.

SUMMARY OF THE INVENTION

With the foregoing and other objects in view, there is provided, in accordance with the invention, a method for applying spacing material to a sheet printed by a printing press, which comprises providing spacing material which is solid at least at ambient temperature, spotwise applying individual spacing material particles formed from the spacing material onto a surface of the sheet, and fixing the applied spacing material particles to the sheet.

In accordance with another mode of the method according to the invention, the spacing material particles have a size ranging from 5 to 30 micrometers and are applied randomly with a mutual mean spacing of 50 to 400 micrometers onto the surface of the sheet so that an at least nearly equal number of spacing material particles is present on portions of equal area of the surface of the sheet.

In accordance with a further mode of the method according to the invention, the spacing material particles are applied onto the surface of the sheet together with an ink or a varnish, and the fixing of the particles to the sheet is effected by drying.

In accordance with an added mode according to the invention, the method includes admixing the spacing material particles with the ink or the varnish in a ratio of from 1:10 to 1:100 (parts by weight).

In accordance with an additional mode, the method according to the invention includes admixing water and a water-soluble adhesive with the spacing material, and applying the mixture in the form of individual spacing material particles having a coating of water and adhesive onto the surface of the sheet.

In accordance with yet another mode of the method according to the invention, the printing press has at least one printing-unit cylinder, and the spacing material particles are applied onto the surface of the sheet indirectly via the at least one printing-unit cylinder.

In accordance with yet a further mode of the method according to the invention, the spacing material particles are applied directly onto the surface of the sheet.

In accordance with yet an added mode of the method according to the invention, the spacing material is provided in the form of spacing material particles having a coating of water-soluble adhesive, and includes, when applying the spacing material particles, moistening the adhesive to activate it so as to fix the spacing material particles to the sheet.

In accordance with yet an additional mode of the method according to the invention, the spacing material is formed of wax which is applied onto the surface of the sheet as wax particles.

In accordance with still another mode, the method according to the invention includes forming the wax particles from a melt by singling out droplets therefrom, the fixing of the wax particles being effected by a partial penetration of the droplets into the sheet or by a firm adhesion thereof to the surface of the sheet, and subsequent cooling and solidifying.

In accordance with still a further mode, the method according to the invention includes forming each of the wax particles of a core formed of a first wax, and a coating formed of a second wax surrounding the core, the second wax having a melting point lower than the melting point of the first wax.

In accordance with still an added mode of the method according to the invention, the wax particles are provided in powder form, and the fixing is performed by a brief thermal treatment.

In accordance with still an additional mode, the method according to the invention includes providing an aqueous suspension containing the wax particles, the fixing of the wax particles onto the surface of the sheet being effected by a brief thermal treatment.

In accordance with another aspect of the invention, there is provided, in a sheet-fed printing press having a rubber blanket cylinder and an impression cylinder, an applicator device for applying in spots particles formed of a spacing material to a sheet printed by the printing press, comprising a container for the spacing material, and rollers operatively associated with one another and with at least one of the cylinders, for taking up the spacing material from the container and for applying the particles formed thereof to the printed sheet, the rollers, the rubber blanket cylinder and the impression cylinder having outer cylindrical surfaces, at least one of the outer cylindrical surfaces being formed with indentations suitable for receiving the spacing material particles therein for applying the spacing material particles in spots to the sheet.

In accordance with a further aspect of the invention, there is provided, in a sheet-fed printing press having an impression cylinder, an applicator device for applying in spots particles formed of a spacing material to a sheet printed by the printing press, comprising a container for the spacing material, and rollers including a take-up roller for taking up the spacing material from the container, and an applicator roller operatively associated with the take-up roller the impression cylinder and the applicator roller being formed with outer cylindrical surfaces, at least one of the outer cylindrical surfaces being formed with indentations suitable for receiving the spacing material particles therein for applying the spacing material particles in spots to the sheet.

In accordance with an added aspect of the invention, there is provided, in a sheet-fed printing press having a rubber blanket cylinder and an impression cylinder, an applicator device for applying in spots particles formed of a spacing material to a sheet printed by the printing press, comprising a container for the spacing material, and rollers including a take-up roller for taking up the spacing material from the container, an applicator roller operatively associated with the take-up roller and with at least one of the rubber blanket and impression cylinders for applying the spacing material particles to the respective cylinder, and an intermediate roller disposed between the take-up roller and the applicator roller, the impression cylinder, the applicator roller and the intermediate roller having outer cylindrical surfaces, at least one of the outer cylindrical surfaces being formed with indentations suitable for receiving the spacing material particles therein for applying the spacing material particles in spots to the sheet.

In accordance with another feature of the invention, the rollers include an applicator roller operatively associated with the impression cylinder, and the impression cylinder has an outer cylindrical surface formed with the indentations.

In accordance with a further feature of the invention, the impression cylinder has an outer cylindrical surface structure with protuberances formed as substantially spherical domes, the indentations being valleys located between the substantially spherical domes and being of such dimensions that at least one spacing material particle is receivable therein.

In accordance with an added feature of the invention, the rollers include an applicator roller operatively associated with at least one of the cylinders, the indentations being formed as wells in the outer cylindrical surface of the applicator roller, the wells substantially matching the size of the spacing material particles.

In accordance with an additional feature of the invention, the rollers include an applicator roller operatively associated with at least one of the cylinders, the indentations being formed as grooves in the outer cylindrical surface of the applicator roller, the grooves extending substantially in circumferential direction of the outer cylindrical surface of the applicator roller and being adapted to the size of the spacing material particles.

In accordance with yet another feature of the invention, the indentations, respectively, are defined by a hydrophilic surface and are surrounded by regions of the respective outer cylindrical surface which are hydrophobic.

In accordance with yet a further feature of the invention, the rollers include a take-up roller for taking up the spacing material from the container, the take-up roller having an elastically yieldable outer cylindrical surface.

In accordance with yet an added feature of the invention, the rollers are rotatable at difference circumferential speeds.

In accordance with an additional aspect of the invention, there is provided, in a sheet-fed printing press having a plurality of printing-unit cylinders, a sprayer for spraying a spray fluid formed of spacing material onto one of a printed sheet and one of the printing unit cylinders, comprising a reservoir for the spray fluid, a nozzle, a pump for supplying the spray fluid from the reservoir to the nozzle, and two rollers disposed parallel to one another and forming a nip therebetween, the rollers defining a spray cone emerging from the nozzle, and a cleaning device operatively associated with the two rollers for removing from the rollers residues of spray fluid adhering to the rollers and returning the residues to the reservoir.

In accordance with yet another feature of the invention, the nozzle is pivotable for interrupting an application of the spray fluid.

In accordance with yet a further feature of the invention, the rollers of the sprayer are disposed so as to be displaceable parallel to one another for enabling a closing of the nip therebetween and interrupting an application of the spray fluid.

In accordance with an added aspect of the invention, there is provided, in a sheet-fed printing press having a plurality of printing-unit cylinders, a sprayer for spraying a spray fluid formed of spacing material onto one of a printed sheet and one of the printing-unit cylinders, comprising a reservoir for the spray fluid directed towards one of the printing-unit cylinders, a nozzle directed towards the one printing-unit cylinder, a container for supplying the spacing material, and a conductive plate disposed so that an opening formed in the nozzle is located in a space between the conductive plate and the one printing-unit cylinder, an electrical field being formable between the one printing unit cylinder and the conductive plate and, when the electrical field is formed, particles of the spacing material being drawn from the nozzle to the one printing-unit cylinder.

In accordance with another feature of the invention, the one printing-unit cylinder is an impression cylinder.

In accordance with a concomitant feature of the invention, the spacing material is in a mixture with an adhesive and, when the electrical field is formed, particles of the mixture are drawn from the nozzle to the one printing-unit cylinder.

An advantage of the embodiment according to the invention is that the spacing material is not applied areally over the entire surface of the sheet of paper but rather only spotwise, i.e., in spots. The result attained is then, on the one hand, economy of spacing material and, on the other hand, the spotwise applied spacing material particles, when the sheets of paper are stacked in a sheet pile, ensure the formation of air cushions between the individual sheets which provide good alignability of the sheet pile without damage to the printed image on a respective sheet and also assure good further processability of the sheets.

Preferably, the spacing material particles have a size ranging from approximately 5 to 30 micrometers and are applied randomly with a mutual mean spacing of 50 to 400 micrometers onto the sheet in such a way that an at least nearly equal number of spacing material particles is present on portions of equal area of the surface of the sheet. The mean spacing, selected from the given range of from 50 to 400 micrometers, depends upon the desired density of coverage of the spacing materials in accordance with the particular printed image involved, the consistency of the inks used for producing it, and the quality or composition of the print medium used. In a preferred exemplary embodiment, the spacing material particles are mixed, prior to the application, with the printing ink, or with the dispersion varnishes used to improve the printed surface of the sheet, and are then applied together to the sheet. Thus, additional devices for applying the spacing material particles can be dispensed with. Fixation of the spacing material particles on the sheet is accomplished accordingly by the automatic adhesion of the particles by means of the printing ink and varnish, respectively, in the course of the drying thereof. The improved properties, especially of the varnish, above all such as its contribution to increasing the sheen, are unimpaired, as long as the size of the particles of spacing material do not exceed a given amount. An upper limit for this amount for this purpose may be set at approximately 10 micrometers.

Preferably, the spacing material particles are admixed with the ink or the varnish in a ratio of from 1:10 to 1:100 (parts by weight).

A further advantageous feature of the method is distinguished in that water and a water-soluble adhesive are admixed with the spacing material, and this mixture is applied to the sheet in the form of individual spacing material particles with a coating of water and adhesive. Further variants of the method according to the invention are that the spacing material particles are applied to the sheet indirectly via at least one printing-unit cylinder or directly.

A further preferred feature is distinguished in that the spacing material is furnished in the form of spacing material particles with a coating of water-soluble adhesive and, upon the application of the spacing material particles, the adhesive is activated by moistening so as to fix the spacing material particles to the sheet.

Furthermore, wax is used as the spacing material, and is applied to the sheet in the form of wax particles.

A variant method based on the foregoing is distinguished in that the wax particles are obtained from a melt, and droplets are singled out therefrom for the application, the fixation of the wax particles being achieved by means of partial penetration of the droplet into the sheet or firm adhesion thereof to the surface of the sheet, and by ensuing cooling and solidification.

In this variation of the method, which is advantageous with a view to the fixation of the wax particles, the wax particles which have not yet entirely solidified partially penetrate into the sheet of paper and are fixed to it automatically as solidification progresses. Another advantage in this respect is that a single-substance system which is easy to handle and easy to control can be used.

A further variant mode of the method is distinguished by forming each of the wax particles as a core of a first wax and providing around the core a coating of a second wax having a lower melting point than that of the first wax.

To fix the wax particles, the coating is first melted while the solidity of the core is preserved. Compared with the variant described initially, it is advantageous, in this regard, that the method can proceed, with the other advantages being the same, at lower values of the temperatures required.

In a further variant mode of the method, the wax particles are furnished in the form of powder, and the fixation is effected by means of brief thermal treatment.

A further variant mode of the method is distinguished, finally, in that an aqueous suspension containing the wax particles is furnished, and the wax particles are fixed on the sheet by means of brief thermal treatment. For performing the method, a printing press for printing sheets, in particular having an inking unit, and having printing unit cylinders in the form of a plate cylinder, a rubber blanket cylinder, and an impression cylinder, is equipped with an applicator device for spotwise application of spacing material particles, formed of a spacing material, to the sheet, with a container for keeping the spacing material on hand, and with rollers in the form of a take-up roller for taking up the spacing material from the container, and an applicator roller associated with the take-up roller; the impression cylinder or the applicator roller has a jacket face or outer cylindrical surface with a surface structure formed with indentations suitable for the spotwise application of the spacing material particles. An alternative to equipping the aforementioned printing press as above is to equip it with an applicator device for spotwise application of spacing material particles to the sheet, a container for keeping the spacing material at hand, and rollers in the form of a take-up roller for taking up the spacing material from the container, an applicator roller for spotwise application of the spacing material particles to the rubber blanket cylinder or the impression cylinder, and an intermediate roller, disposed between the take-up roller and the applicator roller; at least one of the jacket faces or outer cylindrical surfaces of the impression cylinder, the applicator roller and the intermediate roller has a surface structure formed with indentations, which is suitable for the spotwise application of the spacing material particles.

In both cases, there is provided in a preferred feature that the applicator roller be associated with the impression cylinder, and that the impression cylinder have the surface structure formed with indentations.

In an embodiment wherein indentations are formed in the jacket face or outer cylindrical surface of the impression cylinder, the surface structure of the impression cylinder has protuberances in the form of spherical domes, and valleys located therebetween and representing the indentations are of such dimensions that at least one spacing material particle can be received therein, while in another preferred feature, the applicator roller is associated with the impression cylinder or the rubber blanket cylinder, and the indentations are provided in the jacket face of the applicator roller and are formed as wells or grooves extending at least substantially in the circumferential direction of the jacket face, the wells or grooves being adapted to the size of the spacing particles.

In a preferred feature of the printing press which is equipped with the applicator device having the aforementioned intermediate roller, the applicator roller is associated with the impression cylinder or the rubber blanket cylinder, and the indentations are formed in the jacket face or outer cylindrical surface of the applicator roller or the intermediate roller as wells or grooves extending at least substantially in the circumferential direction of the jacket face, the wells or grooves being adapted to the size of the spacing particles.

The aforementioned adaptation or matching of the wells to the size of the spacing material particles is effected in an especially favorable way by dimensioning each well so that it can receive precisely one spacing material particle therein. In this way, the desired distribution of the spacing material particles applied to the sheet can be accomplished directly through the distribution of the wells.

Regardless of which of the aforementioned applicator devices the aforementioned printing press is equipped with, it is furthermore preferably provided that the indentations have a hydrophilic surface and are surrounded by regions of the respective jacket face or outer cylindrical surface which are hydrophobic.

In a further construction of the aforementioned applicator devices, these devices are distinguished by the fact that the take-up roller has an elastic jacket face or outer cylindrical surface, while a further feature, which is advantageous particularly with regard to regulating the mean mutual spacing of the spacing material particles, is distinguished by a difference in the circumferential speeds of the rollers of the applicator device.

In another construction of the invention, a printing press for printing sheets, in particular having an inking unit, and having printing unit cylinders in the form of a plate cylinder, a rubber blanket cylinder, and an impression cylinder, is distinguished by a sprayer which sprays a spray fluid formed of the spacing material onto one of the printing-unit cylinders or onto the sheet, the sprayer including a reservoir for the spray fluid, a nozzle, a pump which supplies the spray fluid from the reservoir to the nozzle, and two rollers disposed parallel to one another and forming a nip therebetween, the two rollers defining a spray cone emerging from the nozzle, and a cleaning device associated with the two rollers for removing from the rollers residues of spray fluid adhering to the rollers and returning the residues to the reservoir.

Also preferably provided is that the nozzle be pivotable, and that the application of the spray fluid can be interrupted by pivoting the nozzle.

In a further construction, the rollers of the sprayer are disposed so as to be displaceable parallel to one another to enable the nip therebetween to be closed, thereby interrupting the application of the spray fluid.

In another construction according to the invention, a printing press for printing sheets, in particular having an inking unit, and having printing unit cylinders in the form of a plate cylinder, a rubber blanket cylinder, and an impression cylinder, is distinguished by a sprayer having a nozzle directed towards a printing-unit cylinder, in particular the impression cylinder, a container for keeping at hand a spacing material, which is optionally formed with an adhesive into a mixture, and a conductive plate which is disposed so that the opening of the nozzle is located in a space between the plate and the printing-unit cylinder, an electrical field being formable between the printing-unit cylinder and the plate, and upon activation of this electrical field, particles of the spacing material and of the mixture, respectively, being drawn from the nozzle to the printing-unit cylinder.

Other features which are considered as characteristic for the invention are set forth in the appended claims.

Although the invention is illustrated and described herein as a method for applying spacing material to a printed sheet, and a sheet-fed printing press equipped for performing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
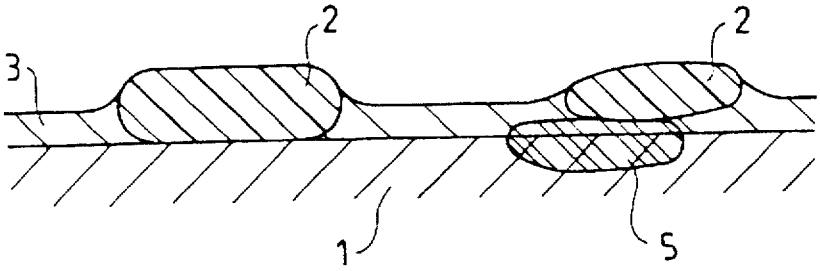
FIG. 1 is a sectional view of a varnish coating with wax particles applied to a printed sheet for explaining a first exemplary mode of the method according to the invention.
Figure 2A:
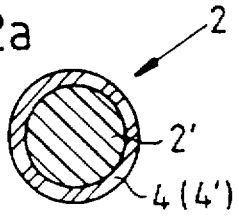
FIG. 2*a* is a cross-sectional view of a core wax particle having a coating formed of a mixture of water and adhesive, or a coating formed of another wax having a lower melting point than that of the core wax.
Figure 2B:
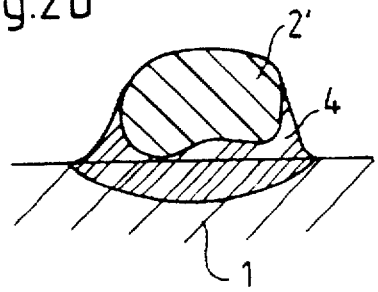
FIG. 2*b* is a view like that of FIG. 1 of the wax particle of FIG. 2*a* after it has been fixed to the sheet.
Figure 3:
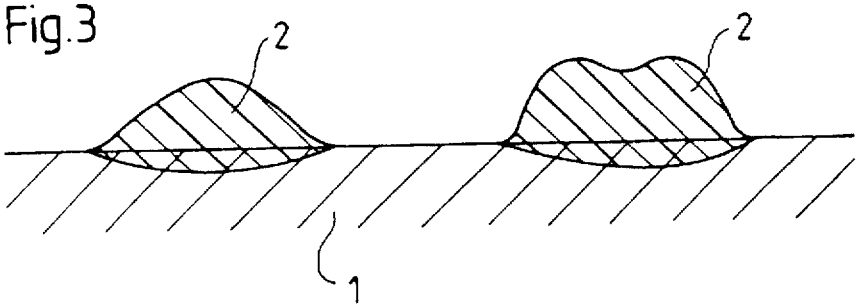
FIG. 3 is a view like that of FIG. 1 showing wax particles originating from a wax melt and applied to a sheet in accordance with a further exemplary mode of the method according to the invention.

Referring now to the drawings and, first, particularly to FIGS. 1 to 3, there are shown therein various possible ways of how the spacing material can be applied to the sheet of paper and fixed thereon. The spacing material is preferably in the form of spherical or droplet-shaped wax particles having a diameter of from 5 to 30 micrometers. This choice of size or diameter of the wax particles provides assurance that they will not be visible to the naked human eye; that is, no color changes, losses of sheen or other changes in optical properties of a printed product are perceptible. The waxes which are preferably used are particularly polyethylene waxes, which has good sliding properties when compared with modern powdered materials, due to the fact that, when suitable pressure is applied per unit of surface area, the wax liquefies at the surface of the wax particles and forms a film of lubricant.

In the example of FIG. 1, the wax particles 2 are admixed with a dispersion varnish 3 which is used to finish the surface of the sheet 1. This occurs preferably in a ratio of from 1:10 to 1:100 (parts by weight). The application of the wax particles 2 to the sheet of paper 1 previously printed with ink 5 is then accordingly performed by a varnishing unit. In this case, the varnish coating 3 applied to the paper to finish it acts as an adhesive for the wax particles 2; the adhesive holds the particles firmly to the surface of the paper and fixes them to the sheet 1 in the course of the drying of the varnish coating.

With respect to FIG. 2*a* and 2*b*, a further possible way of fixing a wax particle 2 to a sheet of paper 1 is described hereinafter. The wax particles 2 are coated, as schematically and diagrammatically shown in FIG. 2*a*, with an aqueous solution 4 of adhesive. The dissolved adhesive has the task of fixing the wax particles 2 to the paper after they have been applied to the sheet 1. The fixing is accomplished by the fact that, after the application of the wax particles 2, the aqueous solution 4 starts to run and penetrates part-way into the paper, as schematically indicated in FIG. 2*b*. The wax particles 2 are fixed in spots on the paper, without any disadvantageous optical effect resulting from the adhesive.

If the wax particles 2 which are used are in the form of a powder or an ingredient in an aqueous suspension without any adhesive component, one option within the scope of the invention for fixing the wax particles 2 to the sheet 1 following the application of the particles 2 to the sheet 1, is a brief heating of the sheet 1. The result thereof is that a film of liquid formed by the suspension and possibly surrounding the wax particles 2 evaporates, and the wax particles 2 are melted at the surface, so that a portion of each particle 2 penetrates the paper and, after cooling has occurred, the wax particles 2 are fixed on the sheet 1.

The aforementioned aqueous suspension can either be furnished for application to the sheet 1 or formed by mixing the wax particles 2, which have been prepared in powdered form, with the liquid ingredient of the suspension during the application of the wax particles 2. In either case, a development of dust is averted.

Instead of a direct application of the wax particles 2 to the paper, an indirect application can also be effected by first applying the wax particles 2 to a roller and only then transferring them to the paper.

Possible ways for coating a wax particle 2 with a coating, such as a coating formed of the aforementioned solution 4, which are within the scope of the invention, are discussed in further detail in the description hereinafter.

With reference to FIG. 3, a further possibility is shown therein for applying and fixing the wax particles 2 to the paper. FIG. 3 diagrammatically shows wax particles 2 which have been applied to the paper. A given portion of the wax of the wax particles 2, as suggested in the drawing, has penetrated the paper, thus achieving the necessary fixation. Because the wax particles 2 are in a solid aggregate state at ambient temperature and thus cannot penetrate into the paper, at least part of the wax particle must be put into a viscous state, so that this part can penetrate into the paper. This can be accomplished, for example, by a heat treatment after the application of the wax particles 2. On the other hand, it is also possible, however, to prepare the wax particles 2 in the form of a melt prior to the application. This requires a temperature of about 100° to 300° C. Wax droplets are formed from this melt, for example, by means of a sprayer according to FIG. 9 or FIG. 12, which are described in detail hereinafter, and sprayed onto the sheet 1. An initially yet-molten wax droplet cools during this process and increasingly solidifies. Upon contact of the wax droplet with the sheet 1, a portion of the wax which has not yet completely solidified penetrates into the paper and, after a further given cooling period and the accompanying solidification thereof, causes the formation of wax particles 2 from the wax droplets and causes the fixation thereof to the sheet 1.

In adjusting the distance covered by the wax droplet between the sprayer and the sheet 1, care must be taken that it not be overly long, on the one hand. If it were too long, the wax droplet would cool down too sharply and would thus no longer have an adequately flowable wax melt as is needed for the fixation. On the other hand, if the distance covered is too short, then the wax droplet does not cool down sufficiently, with the result that the wax droplet striking the paper flows away too readily, so that the height thereof relative to the surface of the paper will be too limited.

A modification of the aforedescribed method is again to use a wax melt for fixation to the paper, however, a wax melt which contains wax particles in an at least approximately solid aggregate state. This can be achieved by providing that two waxes with different melting points be used, the fixing wax having a lower melting point. The fixation of the wax particles, singled out of the melt and then surrounded with a coating of the wax having the lower melting point, is accomplished as in the example described hereinabove by the penetration of the molten wax into the paper and the ensuing solidification.

This offers the advantage that work can be performed with lower temperatures than would be the required for melting the wax particle acting as the spacing material, which must be much stronger mechanically and, therefore, must also have a higher melting point.

A further possible thermal fixing method is to coat the wax particles 2 with a fusion adhesive and then to heat the applied and thus-coated wax particles 2. The temperature provided for this purpose must precisely match the melting point of the fusion adhesive which is then used for fixation. The melting point of the wax particle 2 should not be reached, however, in order to avoid melting thereof.

Instead of coating the wax particles 2 with a fusion adhesive, a water-soluble adhesive can be used for this purpose. This adhesive can then be activated by targeted dampening on the surface of the sheet. Due to the water-absorbing capacity of the paper forming the sheet, the water is again extracted from the adhesive, and the wax particles are then fixed to the surface of the sheet.

With reference to FIGS. 4 to 12, various devices for performing the method according to the invention, and types of embodiments thereof, are described hereinafter.

Figure 4:
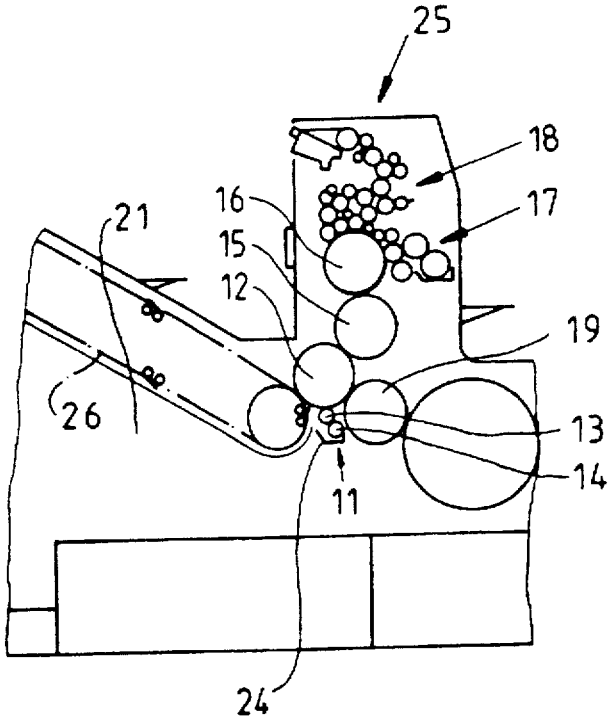
FIG. 4 is a fragmentary, diagrammatic side elevational view of a printing press for printing sheets having an applicator device for applying wax particles which is assigned to a printing-unit cylinder.

FIG. 4 is an illustration of a printing press for printing sheets of paper 1. Specifically shown is a printing unit 25 with an adjoining delivery system 21. The printing unit 25 includes an impression cylinder 12, a rubber blanket cylinder 15 and a plate cylinder 16, around which an inking unit 18 and, in the case where the printing press is operated by the wet offset method, a dampening unit 17 are grouped. A respective sheet 1 is fed to the impression cylinder 12 by means of a sheet guide cylinder 19. Associated with the impression cylinder 12 is an applicator device 11 having an applicator roller 13 and a take-up roller 14 which takes up or accepts a suspension of water, adhesive and spacing material particles 2 from a reservoir 24 wherein the suspension is made ready.

Figure 5A:
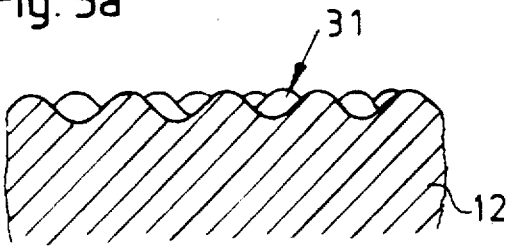
FIG. 5*a* is a fragmentary, greatly enlarged longitudinal sectional view of an impression cylinder, showing the surface structure thereof.
Figure 5B:
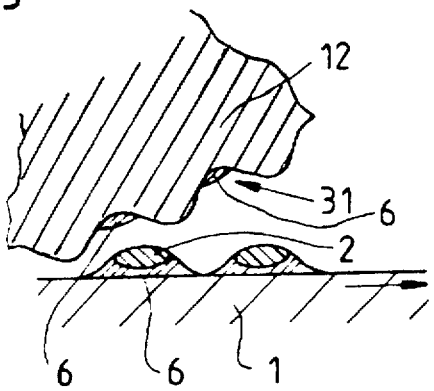
FIG. 5*b* is a fragmentary cross-sectional view of FIG. 5*a*, rotated through approximately 180°, in conjunction with a printed sheet.

In order to apply the spacing material particles 2 spotwise, i.e., in spots, on the sheet 1 in accordance with the invention, the applicator device 11, in a first specific embodiment thereof, has an applicator roller 13 with a smooth jacket face, the impression cylinder 12 of FIG. 5*a* being formed with a jacket face or outer cylindrical surface having spherical domelike protuberances and valleys located therebetween and forming indentations 31, by means of which the desired distribution of the spacing material particles 2 contained in the suspension is forcibly realized. During the contact engagement between the impression cylinder and the paper, the thickness of the coating of water and adhesive, in the non-indented regions of the jacket face of the impression cylinder 12, is too slight to bring about any significant transfer of adhesive onto the paper by liquid separation. The spacing material particles 2 in the indentations 31 adhere to the paper because of the water-soluble adhesive. When the spacing material particles 2 are released from the indentations 31 due to the peeling of the sheet 1 from the impression cylinder 12, only part of the liquid formed of water and adhesive is generally entrained by the respective spacing material particle 2, in the form of a coating thereof, as is schematically shown in FIG. 5*b*. The portion of liquid 6 remaining behind in the indentation 31 does not present any technical disadvantage for the method, however.

The applicator roller 13 may have a diameter like that of the impression cylinder 12 and a corresponding cut-out for the grippers of the impression cylinder 12. However, it may also be formed with a smaller diameter and may be brought into and out of engagement position, for example, by means of a cam control, so that, in a condition wherein it is out of engagement position, it may be out of the way of the grippers of the impression cylinder 12.

The association of the applicator device 11 with the impression cylinder 12 described thus far has the effect that the spacing material particles 2 are not applied to the printed side of the sheet 1, but rather to the rear side thereof. This does not affect the function of the spacing material particles 2 as spacers, however.

Figure 6A:
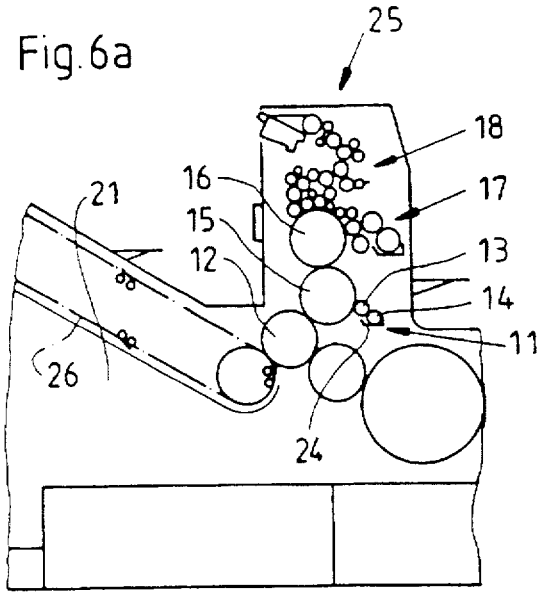
FIGS. 6*a* and 6*a* are views like that of FIG. 4, wherein the applicator device is disposed in different locations of the printing press.
Figure 6B:
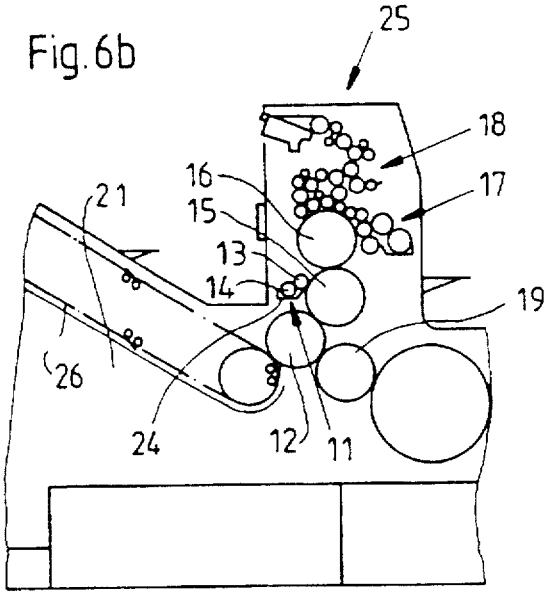

FIGS. 6*a*and 6*a*, respectively, illustrate part of a printing press which is substantially equivalent to what is shown in FIG. 4. Unlike the exemplary embodiment shown in FIG. 4, however, here the applicator device 11 is not associated with the impression cylinder 12 but rather with the rubber blanket cylinder 15; as shown in FIG. 6*a*, the applicator device 11 is disposed relative to the rubber blanket cylinder 15 in such a way that, initially, ink and then the spacing material particles 2 are transferred to the rubber blanket cylinder 15. This arrangement or order is transposed in the embodiment according to FIG. 6*b*.

Because the rubber blanket cylinder 15 has a substantially smooth surface, in the exemplary embodiments according to FIGS. 6*a* and 6*a*, the jacket face of the applicator roller 13 of the applicator device 11 is provided with a predetermined surface structure, so that the spacing particles 2 are applied to the paper spotwise, i.e., in spots, and with the hereinaforedescribed desired distribution, by means of a rubber blanket fastened to the rubber blanket cylinder 15.

In an advantageous feature, the jacket face of the applicator roller 13 have wells or cup-like recesses 27 formed therein. These wells 27 are of such dimensions that they can receive therein precisely one particle 2 of spacing material, together with some adhesive dissolved in water. Preferably, the surfaces of the wells 27 are hydrophilic, while the other surface portions of the jacket face of the applicator roller 13, which come into contact with the rubber blanket of the rubber blanket cylinder 15, preferably have a hydrophobic property, for example, due to a special coating provided thereon. As described hereinbefore in conjunction with FIG. 4, the spacing material particles 2 and the suspension, respectively, are taken from the reservoir 24 by means of the take-up roller 14 and are supplied to the applicator roller 13. Sustained or assisted by the aforedescribed take-up performance of the jacket face regions of the applicator roller 13, the wells 27 are filled with the spacing material particles 2 and the suspension, respectively, while the nonindented jacket face regions of the applicator roller 13 remain uninvolved in any transfer of spacing material particles 2. The desired distribution of the spacing material particles 2 is thereby determined by a corresponding distribution of the wells 27 of the applicator roller 13.

Figure 7A:
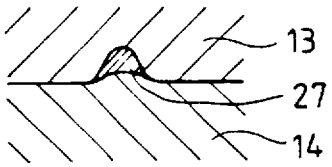
FIGS. 7*a* and 7*b* are fragmentary, greatly enlarged sectional views of a take-up roller and an applicator roller of different embodiments of the applicator device according to the invention.

The take-up roller 14 is preferably provided with an elastic jacket face or outer cylindrical surface. The contact pressure between the applicator roller 13 and the take-up roller 14 is adjusted so that if a well 27 is filled without a spacing material particle 2, most of the liquid is squeezed back out of the well again. This process is diagrammatically illustrated in FIGS. 7*a* and 7*b*. FIG. 7*a* shows the situation wherein a well 27 is filled without a spacing material particle 2. Due to the choice of a take-up roller 14 with an elastic jacket face or outer cylindrical surface, a region of the jacket face of the take-up roller 14 located above the well 27 of the applicator roller 13 bulges into the well 27. The extent of bulging depends, on the one hand, upon the elasticity of the jacket face and, on the other hand, upon the contact pressure between the applicator roller 13 and the take-up roller 14. The effect of this bulging is that a liquid, in particular water-soluble adhesive, which might be located in the well 27, is squeezed out of it if there is no spacing material particle 2 in the well 27. This prevents adhesive dissolved in water without spacing material particles 2 from being transferred and thereby optically impairing the printed product.

Figure 7B:
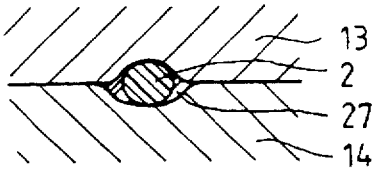

FIG. 7*b*, conversely, shows the situation wherein a spacing material particle 2 is located in one of the wells 27 of the applicator roller 13. The spacing material particle 2 ensures the bulging of the elastic jacket face of the take-up roller 14 towards the axis thereof, as suggested diagrammatically in this figure. In the choice of the contact pressure and of the material for forming the elastic jacket face of the take-up roller 14, respectively, care should be taken that, with the preferred use of wax particles as spacing material particles 2, a respective wax particle 2 will not deform excessively upon contact with the applicator roller 13.

To facilitate the filling of the wells 27 with a respective wax particle 2 during operation, the drive of the two rollers 13 and 14 can be constructed so that preferably a low relative speed which is variable prevails between these two rollers. An advantage thereof is that the wax particles 2 slip into the wells 27 more easily due to the friction between the two jacket faces of the rollers 13 and 14.

Figure 8A:
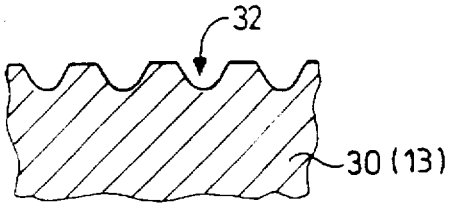
FIG. 8*a* is a fragmentary, greatly enlarged longitudinal sectional view of a roller formed with indentations which is provided for the spacing material, and which forms part of the applicator device.
Figure 8B:
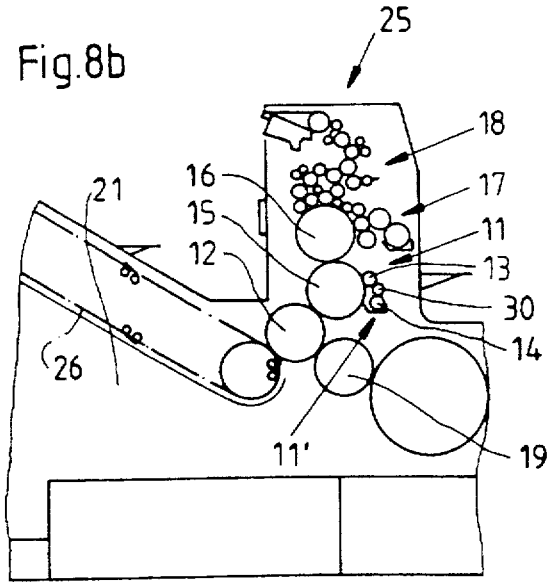
FIG. 8*b* is a view like that of FIG. 6*a*, illustrating the disposition of an applicator device for the spacing material.

The embodiment of the applicator device 11' shown in FIG. 8*b* has been slightly modified in comparison with the applicator device described hereinbefore. The suspension taken up by the take-up roller 14 is not transferred directly to the applicator roller 13, in the embodiment of FIG. 8*b*, but instead is first transferred to an intermediate roller 30, from which it is then passed on to the applicator roller 13.

Instead of a surface structure formed by means of the wells 27, the intermediate roller 30, and the applicator roller 13, as well, may be formed with flutes or grooves 32 extending either in the circumferential direction of the jacket face or in a direction inclined thereto, as is diagrammatically shown in FIG. 8*a*. The mode of operation in taking up the wax particles 2 and passing them onto the applicator roller 13 and to the rubber blanket cylinder 15, respectively, is essentially equivalent to that of the jacket face provided with the wells 27. The desired distribution of the wax particles 2 is attained by means of a suitable selection of the spacings between the grooves 32 and of a circumferential speed of the intermediate roller 30, which then optionally differs from that of the applicator roller 13. For example, if the applicator roller 13 has the same circumferential speed as the rubber blanket cylinder 15, and the intermediate roller 30 has a lower circumferential speed, then the wax particles 2 located in the various grooves 32 of the intermediate roller 30 are transferred to the applicator roller 13 at a spacing which is increased in comparison with a spacing between the wax particles 2 located in the groove 32.

As mentioned hereinbefore, the applicator device 11 may, for example, also be located before the plate cylinder 16 or may be associated with the impression cylinder 12.

For attaining the desired distribution of wax particles 2, a surface structure formed by indentations 31 in the form of valleys between spherical dome-shaped protuberances, or by wells 27 or grooves 32 is, in principle, required only on one of the jacket faces involved in the transfer of the wax particles 2. However, it can certainly be advantageous if, along the path of the wax particles 2 from the reservoir 24 to the jacket face of the impression cylinder 12 and of the rubber blanket cylinder 15, respectively, two jacket faces or outer cylindrical surfaces, respectively, provided with a surface structure, follow one another, such as, for example, along the path to the rubber blanket cylinder 15, a jacket face of the intermediate roller 30 provided with the grooves 32 and a jacket face of the applicator roller 13 provided with the wells 27, or also a jacket face of the applicator roller 13 provided with grooves 32, the grooves of the intermediate roller 30 and the applicator roller 13 having a different inclination relative to the longitudinal axis of the respective roller, or as an another example, along the path to the impression cylinder 12, a jacket face of the applicator roller 13 provided with the grooves 32 and a jacket face of the impression cylinder 12 provided with the indentations 31 in the form of the valleys between the spherical dome-shaped protuberances.

As mentioned hereinbefore, instead of applying the wax particles 2 by means of the applicator roller 13 of the applicator device 11 or 11', the wax particles 2 may be applied by a sprayer 40 which sprays a spray fluid including the spacing material, and which can be disposed in the printing press in such a manner that the sheet 1 itself, or an impression cylinder in contact therewith, is sprayed therewith. The spray fluid may be in the form of the aforementioned melt of the wax used as the spacing material, or in the form of the aforementioned aqueous suspension which contains both the wax particles 2 and an adhesive dissolved in water.

Figure 9:
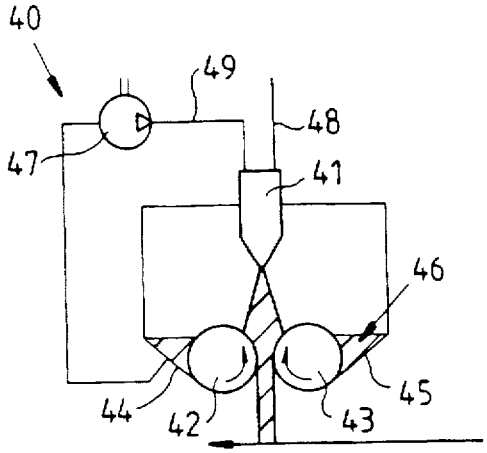
FIG. 9 is a schematic and diagrammatic view of a sprayer for applying the spacing material.

In general, such a sprayer 40 includes nozzles 41, which are supplied, on the one hand, with compressed air via a corresponding compressed-air line 48 and, on the other hand, with the spray fluid via a line 49 for sprayable material. The spray fluid supplied via the sprayable material line 49 is aspirated from a reservoir 46 by means of a pump 47. For defining or limiting a spray cone produced at a respective nozzle 41, a limiting device, preferably formed of two rollers 42 and 43, is provided, as shown in FIG. 9. The disposition of the two rollers 42 and 43 is such that a gap is formed therebetween through which some of the spray cone can pass. To prevent residues of the spray fluid, which have deposited on the jacket faces of the rollers 42 and 43, from clogging the gap, the two rollers 42 and 43 are rotated and any accumulations thereon are scraped off. The direction of rotation is selected so that the two jacket faces rotate counter to the spray direction in the region of the gap.

A cleaning device for the rollers 42 and 43, which is in the form of squeegees 44 and 45 in the arrangement shown in FIG. 9, cleans the rollers 42 and 43 of adhering residues of spray fluid and returns those residues to the reservoir 46.

Figure 10A:
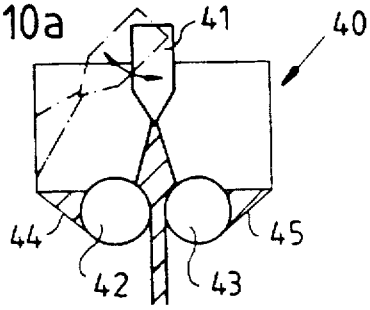
FIGS. 10*a* and 10*b* are views like that of FIG. 9 showing the sprayer in different operating phases thereof wherein a spray cone discharged from the sprayer is interrupted.
Figure 10B:
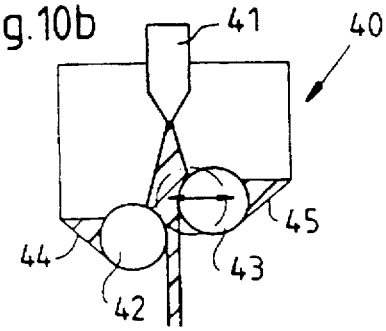

The quantity of spray fluid passing between the rollers 42 and 43 can be controlled not only by adjusting spray parameters such as the quantity of compressed air or the quantity of spray fluid supplied to the nozzle, but also by the width of the aforementioned gap. In this regard, the rollers 42 and 43 are disposed so as to be adjustable relative to one another. In addition to a parallel displacement of the two rollers 42 and 43 relative to one another, which produces a constant width of the gap over the entire length of the rollers 42 and 43, it is also conceivable to establish a different width of the gap along the width of the printing press, by means of a corresponding displacement of one of the rollers 42 and 43. To turn off the spray cone and to interrupt it, respectively, in addition to shutting off the pump 47 and compressed air 48, respectively, the possibility exists of pivoting the nozzle 41 in such a way that the spray cone output therefrom does not reach the gap, an option which is shown in FIG. 10*a*. In this regard, suitable assurance is provided even then that the spray fluid reaches the reservoir 46. In the example shown in FIG. 9, this is achieved by providing that the nozzle 41 is located inside the spray container 46 and is aimed, for example, at a side wall thereof after being pivoted. A further option is to close the gap formed by the two rollers 42 and 43 by moving them towards one another, as diagrammatically shown in FIG. 10*b*. Not only a parallel displacement of one of the rollers 42 and 43, but also a displacement into an obliquely upwardly directed or obliquely downwardly directed position is possible.

By suitably interrupting the spray cone, a possible spraying of gripper devices, for example, by means of which the sheets 1 are transported, may be avoided.

Figure 11A:
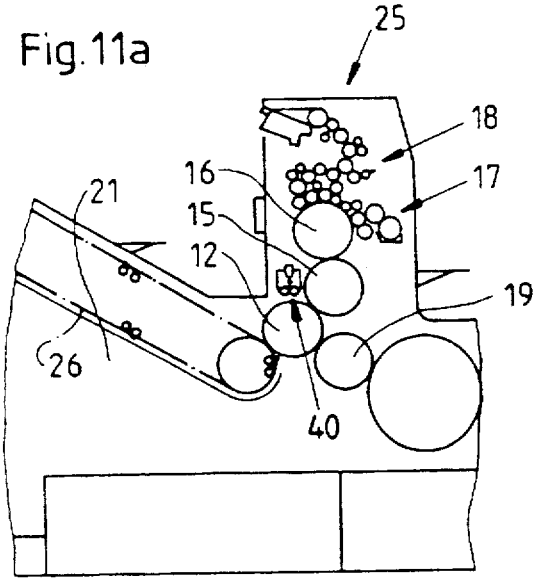
FIGS. 11*a* and 11*b* are views like that of FIG. 4 showing the sprayer of FIG. 9 in different positions in the printing press.
Figure 11B:
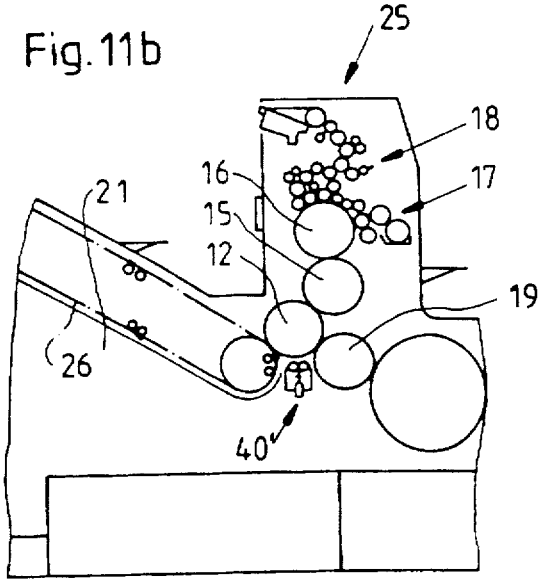

Just as in the case wherein the hereinaforedescribed applicator device 11 is used, various options exist for disposing the sprayers 40 in the printing press, whenever the sprayers 40 are used. Two of these options are shown in FIGS. 11*a* and 11*b*. In FIG. 11*a*, the sprayer 40 is disposed so that the spray fluid strikes the printed side of the sheet 1. In FIG. 11*b*, conversely, a sprayer 40' having the same functional principle as the sprayer 40 is aimed at a region of the impression cylinder 12 on which the sheet 1 rests in the further course of the rotation of this cylinder. The application of spray fluid thus takes place indirectly, via the impression cylinder 12, onto the rear side of the sheet 1. Naturally, other conceivable arrangements are also possible.

Figure 12:
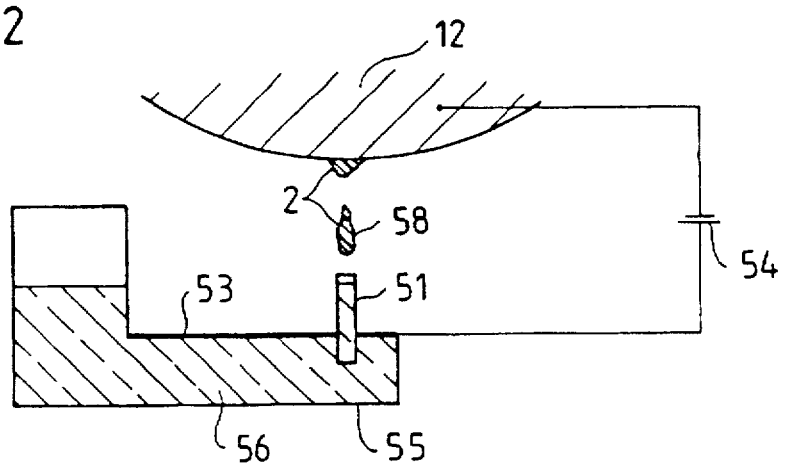
FIG. 12 is a schematic and diagrammatic view of another embodiment of the applicator device for the spacing material constructed in accordance with the invention.

FIG. 12 diagrammatically shows another embodiment of a sprayer which, in contrast with the sprayer 40 described hereinbefore, instead of using compressed air, uses an electrical field to eject the spray fluid.

The sprayer 60 shown in FIG. 12 includes a nozzle 51, which is supplied with the spray fluid from a reservoir 55. The nozzle 51 in this example is aimed radially at the impression cylinder 12. An electrical voltage, which builds up an electrical field, is applied, on the one hand, to a plate 53 which is disposed substantially perpendicularly to the direction in which the nozzle 51 extends and, on the other hand, to the impression cylinder 12.

The spray fluid contained in the reservoir 55 is preferably a mixture 56 of wax particles 2 in an adhesive solution. By means of the electrical field, the wax particles 2 and the adhesive 58 adhering thereto are accelerated; in the final analysis, this adhesive 58 assures the requisite fixation of the wax particles 2 to the paper of the sheet 1.

This device 60 can preferably be disposed at the same locations in the printing press as the aforementioned applicator devices 11, 11', 40 and 40'. A nozzle array is disposed over the entire width of the sheet 1 transversely to the sheet travel direction. The spotwise application of the wax particles and the control of the quantity of fluid which is applied are provided by turning the applied voltage on and off.

We claim:

1. Method for applying spacing material to a sheet printed by a printing press, which comprises:

providing spacing material which is solid at least at ambient temperature;

spotwise applying individual spacing material particles formed from the spacing material onto a surface of the sheet, the spacing material being formed of wax which is applied onto the surface of the sheet as wax particles;

forming each of the wax particles of a core formed of a first wax, and a coating formed of a second wax surrounding the core, the second wax having a melting point lower than the melting point of the first wax; and fixing the applied spacing material particles to the sheet.

2. Method according to claim 1, wherein the spacing material particles have a size ranging from 5 to 30 micrometers and are applied randomly with a mutual mean spacing of 50 to 400 micrometers onto the surface of the sheet so that an at least nearly equal number of spacing material particles is present on portions of equal area of the surface of the sheet.

3. Method according to claim 1, wherein the spacing material particles are applied onto the surface of the sheet together with an ink or a varnish, and wherein the fixing of the particles to the sheet is effected by drying.

4. Method according to claim 3, which includes admixing the spacing material particles with the ink or the varnish in a ratio of from 1:10 to 1:100 (parts by weight).

5. Method according to claim 1, which includes admixing water and a water-soluble adhesive with the spacing material, and applying the mixture in the form of individual spacing material particles having a coating of water and adhesive onto the surface of the sheet.

6. Method according to claim 1, wherein the printing press has at least one printing-unit cylinder, and wherein the spacing material particles are applied onto the surface of the sheet indirectly via the at least one printing-unit cylinder.

7. Method according to claim 1, wherein the spacing material particles are applied directly onto the surface of the sheet.

8. Method according to claim 1, which includes further forming the wax particles from a melt by singling out droplets therefrom, and wherein the fixing of the wax particles is effected by a partial penetration of the droplet into the sheet or by a firm adhesion thereof to the surface of the sheet, and subsequent cooling and solidifying.

9. The method according to claim 1, which further comprises adhesively fixing the spacing material particles to the sheet.

10. In a sheet-fed printing press having a rubber blanket cylinder and an impression cylinder, an applicator device for applying in spots particles formed of a spacing material to a sheet printed by the printing press, comprising:

a container for the spacing material, and rollers operatively associated with one another and with at least one of the cylinders, for taking up the spacing material from said container and for applying the particles formed thereof to the printed sheet, said rollers, the rubber blanket cylinder and the impression cylinder having outer cylindrical surfaces, at least one of said outer cylindrical surfaces being formed with indentations suitable for receiving the spacing material particles therein for applying the spacing material particles in spots to the sheet, and said rollers include an applicator roller operatively associated with the impression cylinder, and the impression cylinder having an outer cylindrical surface formed with said indentations.

11. In a sheet-fed printing press having a rubber blanket cylinder and an impression cylinder, an applicator device for applying in spots particles formed of a spacing material to a sheet printed by the printing press, comprising:

a container for the spacing material, and rollers operatively associated with one another and with at least one of the cylinders, for taking up the spacing material from said container and for applying the particles formed thereof to the printed sheet, said rollers, the rubber blanket cylinder and the impression cylinder having outer cylindrical surfaces, at least one of said outer cylindrical surfaces being formed with indentations suitable for receiving the spacing material particles therein for applying the spacing material particles in spots to the sheet, and the impression cylinder has an outer cylindrical surface structure with protuberances formed as substantially spherical domes, said indentations being valleys located between said substantially spherical domes and being of such dimensions that at least one spacing material particle is receivable therein.

12. Applicator device according to claim 11, wherein said rollers include an applicator roller operatively associated with at least one of the cylinders, said indentations being formed as wells in said outer cylindrical surface of said applicator roller, said wells substantially matching the size of the spacing material particles.

13. Applicator device according to claim 11, wherein said rollers include an applicator roller operatively associated with at least one of the cylinders, said indentations being formed as grooves in said outer cylindrical surface of said applicator roller, said grooves extending substantially in circumferential direction of said outer cylindrical surface of said applicator roller and being adapted to the size of the spacing material particles.

14. Applicator device according to claim 11, wherein said indentations, respectively, are defined by a hydrophilic surface and are surrounded by regions of the respective outer cylindrical surface which are hydrophobic.

15. Applicator device according to claim 11, wherein said rollers include a take-up roller for taking up the spacing material from said container, said take-up roller having an elastically yieldable outer cylindrical surface.

16. In a sheet-fed printing press having a rubber blanket cylinder and an impression cylinder, an applicator device for applying in spots particles formed of a spacing material to a sheet printed by the printing press, comprising:

a container for the spacing material, and rollers operatively associated with one another and with at least one of the cylinders, for taking up the spacing material from said container and for applying the particles formed thereof to the printed sheet, said rollers, the rubber blanket cylinder and the impression cylinder having outer cylindrical surfaces, at least one of said outer cylindrical surfaces being formed with indentations suitable for receiving the spacing material particles therein for applying the spacing material particles in spots to the sheet, and said rollers rotatable at difference circumferential speeds.

* * * * *